US007675239B2

(12) United States Patent
Marhefka et al.

(10) Patent No.: US 7,675,239 B2
(45) Date of Patent: Mar. 9, 2010

(54) POWER MANAGEMENT METHOD AND DEVICE FOR LOW-POWER DISPLAYS

(75) Inventors: Duane Marhefka, Copley, OH (US); Todd Ernst, Tallmadge, OH (US); Xiao-Yang Huang, Stow, OH (US)

(73) Assignee: Kent Displays Incorporated, Kent, OH (US)

( * ) Notice: Subject to any disclaimer, the term of this patent is extended or adjusted under 35 U.S.C. 154(b) by 876 days.

(21) Appl. No.: 11/464,698

(22) Filed: Aug. 15, 2006

(65) Prior Publication Data

US 2008/0037306 A1 Feb. 14, 2008

Related U.S. Application Data

(60) Provisional application No. 60/822,128, filed on Aug. 11, 2006.

(51) Int. Cl.
*G09G 3/10* (2006.01)

(52) U.S. Cl. ..... 315/169.3; 345/87; 345/204; 363/21.01; 363/149

(58) Field of Classification Search ... 315/169.1–169.4; 363/15, 21.01, 21.04, 149; 345/84, 87, 102, 345/204

See application file for complete search history.

(56) References Cited

U.S. PATENT DOCUMENTS 5,712,692 A 1/1998 Kanagawa et al.
5,712,778 A 1/1998 Moon
5,877,736 A 3/1999 Imajo et al.
5,920,466 A 7/1999 Hirahara
6,118,439 A 9/2000 Ho et al.
6,172,661 B1 1/2001 Imajo et al.
6,373,479 B1 4/2002 Moon
6,381,151 B1 * 4/2002 Jang ..... 363/21.01
6,385,061 B1 * 5/2002 Turchi et al. ..... 363/21.15
6,515,874 B2 * 2/2003 Feldtkeller ..... 363/21.01
6,633,287 B1 10/2003 Yatabe et al.
6,897,845 B2 5/2005 Ozawa
7,511,437 B2 * 3/2009 Lys et al. ..... 315/307
2002/0110009 A1 8/2002 Umeda
2003/0222631 A1 12/2003 Voto et al.
2004/0095105 A1 5/2004 Nakata
2004/0113907 A1 6/2004 Lee et al.
2004/0160791 A1 8/2004 Haus et al.
2005/0073490 A1 4/2005 Kojima et al.
2006/0012585 A1 1/2006 Schoofs et al.

* cited by examiner

*Primary Examiner*—Douglas W Owens
*Assistant Examiner*—Jimmy T Vu
(74) *Attorney, Agent, or Firm*—Pearne & Gordon LLP

(57) ABSTRACT

A device and method for supplying a display, such as a liquid crystal display, for example a bistable ChLCD, with drive voltages for extremely low power operation. The method and the device implementing the method provides an energy storage device and a voltage converter being utilized to store energy in the storage device, such that a display can be driven during an inactive, powered-down phase of the converter by using the stored energy to drive the display.

32 Claims, 5 Drawing Sheets

POWER MANAGEMENT METHOD AND DEVICE FOR LOW-POWER DISPLAYS

CROSS-REFERENCES TO RELATED APPLICATIONS

This application claims the benefit of co-pending provisional application No. 60/822,128, filed on Aug. 11, 2006 and incorporated herein by reference.

BACKGROUND OF THE INVENTION

This application relates generally to a method and device for saving power. More specifically, this application relates to a method and device for using dc-to-dc conversion circuitry in driving a liquid crystal display in a manner that reduced power consumption.

Bistable liquid crystal displays, and in particular, cholesteric liquid crystal displays (ChLCDs), have great potential for use in battery operated devices. The bi-stable property of ChLCDs permits an image to be placed on the display and maintained indefinitely without refresh. Thus, power is consumed only to change the image content, not to maintain it. This can result in significant power savings versus STN or TN displays, especially for relatively static image content.

However, recent application opportunities for ChLCD require even more aggressive power management than afforded by the bi-stability alone. For example, small devices powered by coin cell batteries, such as watches, for example, must achieve the maximum possible number of display updates from a single battery. Typically, it is a design goal to minimize the size (and thus typically reducing the capacity) of the battery as well. A key design challenge for such small displays is generating the ChLCD drive voltages (~35V) with the efficiency required to produce the desired battery lifetime. This is made difficult by the very small current draw of the display relative to the relatively larger quiescent currents of the dc/dc conversion circuitry.

Accordingly, it would be useful to save power in the operation of the dc-to-dc conversion circuitry. Furthermore, it would be even more useful if such a method would utilize off-the-shelf dc-to-dc converters or circuits that incorporate them.

SUMMARY OF THE INVENTION

Provided is an apparatus for driving a display, comprising: a power supply for outputting energy at a supply voltage; a converter for converting the supply voltage of the power supply into a converted voltage; a controller for controlling an operation of the converter; and an energy storage device for storing energy outputted by the converter at the converted voltage.

The storage device is also for providing stored energy to the display, and the controller controls the converter such that the converter supplies the converted voltage to the storage device for a first time interval but not for a second time interval, wherein the first time interval has a duration that is less than the duration of the second time interval. The storage device supplies a driving voltage to the display during the second time interval, the driving voltage sufficient to drive the display.

Also provided is an apparatus for driving a display, comprising: a power supply for outputting energy at a supply voltage; a converter for converting the supply voltage of the power supply into a converted voltage; and an energy storage device for storing energy outputted by the converter at the converted voltage.

The storage device is also for providing stored energy to the display. The apparatus is adapted such that the converter circuit provides energy at the converted voltage to the storage device to charge the storage device during a converter active phase. The apparatus is also adapted to deactivate the converter during a converter inactive phase where the converter is not providing any substantial energy to the energy storage device, such that a consumption of power by the converter is substantially reduced during the inactive phase. The storage device provides stored energy to the display for updating a display image during a driving phase that overlaps at least a substantial portion of the inactive phase.

Still further provided is an apparatus for driving an LCD display, comprising: a dc power supply for outputting energy at a supply voltage; a dc-to-dc converter for converting the supply voltage of the power supply into a converted voltage; a driver for driving the display; an energy storage device for storing energy outputted by the converter at the converted voltage, the storage device also for providing stored energy to the display driver; and a controller for controlling a timing of an active phase, an inactive phase, and a driving phase.

The controller controls the converter for providing energy at the converted voltage to the storage device to charge the storage device during the active phase, and the controller deactivates the converter during the inactive phase such that the converter is not providing any substantial energy to the energy storage device, wherein a consumption of power by the converter is substantially reduced during the inactive phase.

The storage device provides stored energy to the display driver for updating a display image on the display during at least a substantial portion of the driving phase that does not overlap with the active phase, with the duration of the driving phase being longer than the duration of the active phase.

Further provided is a method of using a commercial voltage converter to power a display, with method comprising the steps of:

storing energy provided by the converter during an active phase;

not providing energy from the converter during an inactive phase, wherein power consumption by the converter during the inactive phase is substantially reduced; and updating an image on a display during at least a portion of the inactive phase using stored energy, wherein the duration of the at least a portion of the inactive phase is longer than the duration of the active phase.

Also provided are additional embodiments of the invention, some, but not all of which, are described hereinbelow in more detail.

BRIEF DESCRIPTION OF THE DRAWINGS

The foregoing and other features and advantages of the present invention will become apparent to those skilled in the art to which the present invention relates upon reading the following description with reference to the accompanying drawings, in which.

DETAILED DESCRIPTION OF EXAMPLE EMBODIMENTS

Provided is a device and method for supplying a display, such as a liquid crystal display, for example a bistable ChLCD, with drive voltages for extremely low power operation. The method enables, for example, the use of small displays operating with coin (button) batteries, including devices such as watches, calculators, etc. with the desired longer battery lifetime. Implementation of the inventive method and circuit serves to counter the quiescent current draw of the voltage conversion circuitry.

Figure 1:
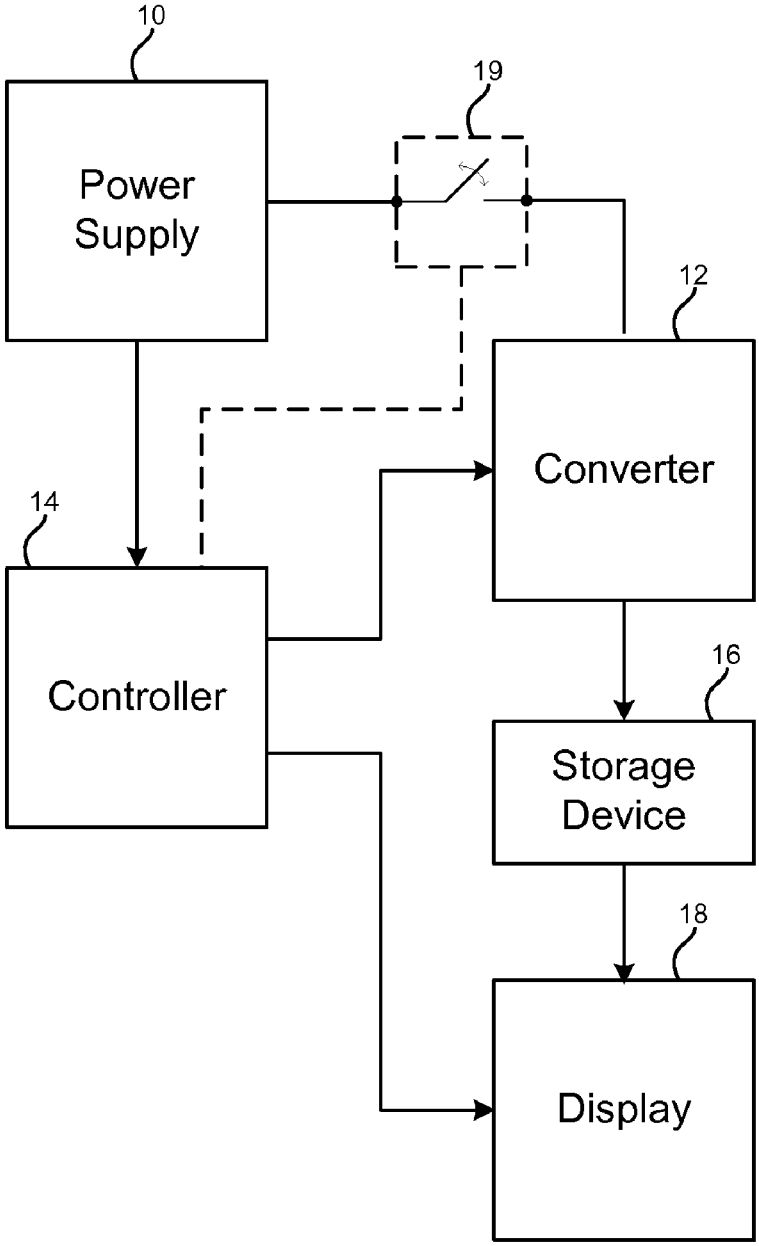
FIG. 1 is a block diagram showing a simplified generic embodiment of the invention.

FIG. 1 shows a block diagram of a simplified generic embodiment of the invention. A power supply 10 is used to provide power to a converter 12 and a controller 14, and perhaps other circuit components, shown and/or not shown. Alternatively, a separate power supply might supply the controller 14, and/or other circuit components. The converter 12 can be, for example, a dc-to-dc converter for converting the output of the power supply 10, which could be a dc battery cell, for example, into a sufficient voltage to drive the display circuitry. Storage device 16 stores energy output by converter 12, and can output that energy at a desired voltage or voltage range. Thus, the converter 12 provides energy of a sufficient voltage to the storage device 16 (and perhaps to a display 18 as well), and the storage device 16 ultimately can provide power to the display 18 when the converter 12 cannot (such as when it is powered down). The display 18 may comprise an LCD and an LCD driver circuit, for example, and in particular a bistable LCD could be utilized.

Power savings can be obtained by the controller 14 controlling the converter 12 such that the converter 12 is only on for short periods of time sufficient to supply the storage device 16 with enough energy to maintain a proper output voltage to support updating (and/or maintaining) an image provided by the display 18, even when the converter 12 is powered down. This technique can be utilized by commercially available off-the-shelf (OTS) converters that were not designed for operating in this manner, but that can provide sufficient power during power-on to both supply the display 18, and charge the storage device 16 sufficient to drive the display 18 during at least a portion of a period of converter 12 power down.

Additional embodiments might control the converter 12 in a manner other than using a controller 14, such as by using an internal controller or other switching circuit, for example, or some other method or circuit for powering the converter 12 up and down, as desired.

Figure 4:
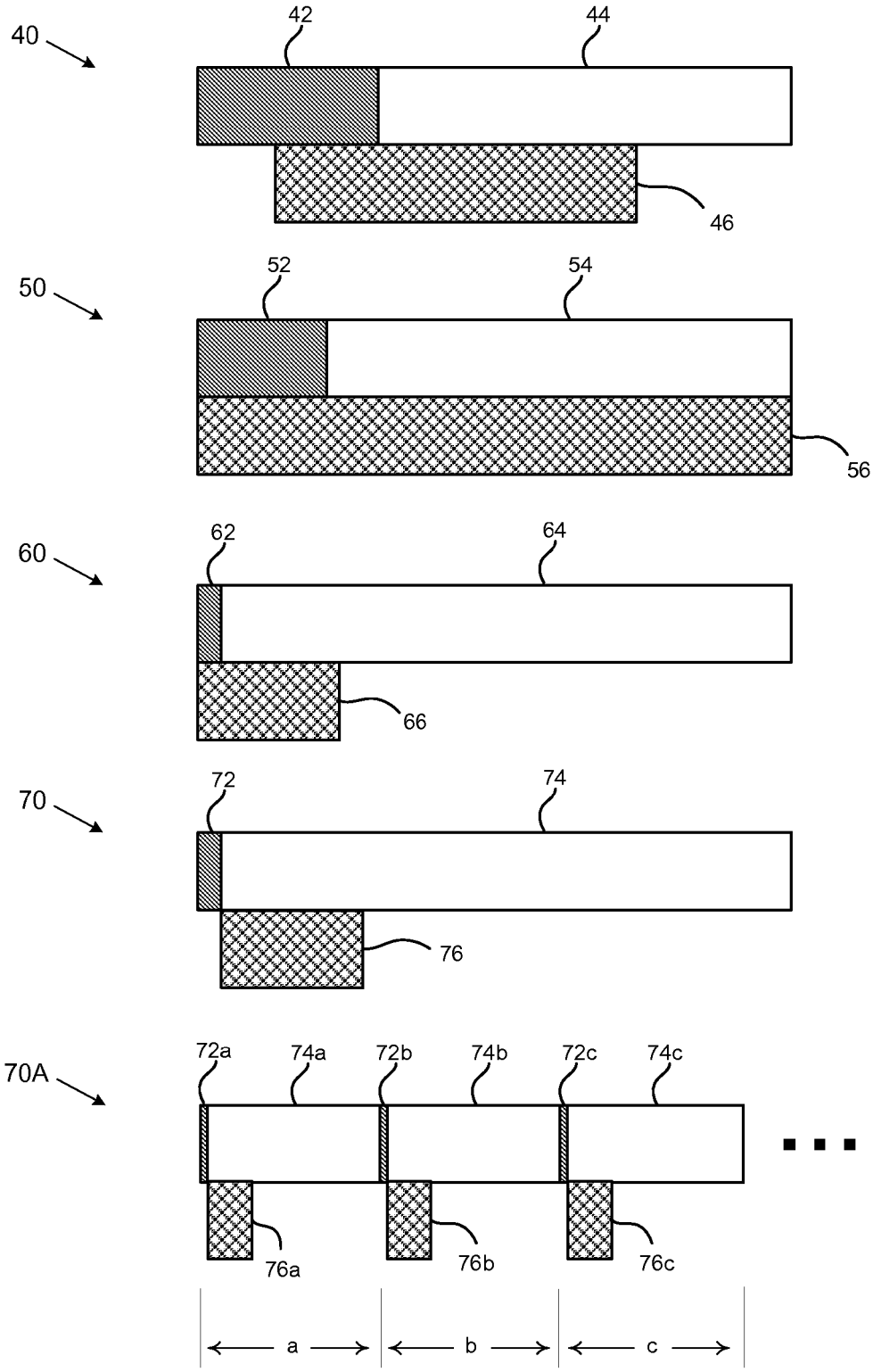
FIG. 4 shows various timing schemes for practicing various embodiments of the invention.

FIG. 4, reviewed in relation to FIG. 1, shows various timing diagrams for showing examples of how the method may be implemented for various implementations. Time moves from left to right in the diagrams of FIG. 4 along an imaginary "x-axis" (not shown).

Scheme 40 of FIG. 4 shows an active phase 42 where the converter 12, which is powered-up, is actively charging the storage device 16 for a particular time interval. An inactive phase 44 is shown where the converter 12 is inactive (e.g., powered down) for another time interval, and thus in a power saving mode where power used by the converter 12 is drastically reduced as compared to the active phase 42. Finally, a driving phase 46 is provided where the display 18 is driven for a certain time interval to maintain a display image, or update the display image, as is appropriate for the chosen application (note that a bistable display can be utilized that only requires driving power be provided during image updates/changes).

In scheme 40, note that the driving phase only partially overlaps both the active and the inactive phases. Of course, different amounts of overlap can be accommodated, as desired, until, as shown in scheme 50, the driving phase 56 overlaps both the entire active phase 52, and the entire inactive phase 54. Such a scheme could be utilized where power is required to maintain an image provided by the display, or where image updates are required often (such as in a video display, for example), and thus the display requires power nearly continuously.

Scheme 60 provides phase timings and durations that allow the converter to power the display at the same time as the converter charges the storage device. Hence, driving phase 66 overlaps all of the active phase 62, and at least a portion of the inactive phase 64.

Finally, scheme 70 provides phase timings and durations that are more consistent with the example embodiments for the commercial converters discussed below. Hence, active phase 72 is very short when compared to either the driving phase 76 or the inactive phase 74 to conserve power, and the driving phase 76 is also short when compared to the inactive phase 74. Furthermore, there is a substantial portion of the inactive phase where no driving takes place (i.e., where the driving phase 76 does not overlap the inactive phase 64).

Furthermore, the driving phase 76 is typically started either once the active phase 72 has ended, or thereabouts. This is so that the storage device (which is substantially discharged at the start of the active phase, both due to prior discharge into the display and due to leakage) does not keep down the voltage provided to the display while the converter is charging the storage device, especially in the situation where capacitors are utilized as part of the storage device. As the converter charges the storage device, the available voltage rises, until it can again be used to drive the display.

Scheme 70 can be repeated cyclically, as shown in scheme 70A of FIG. 4, for the situation where the display 18 is to be periodically updated on a regular, uniform basis. Thus, during each period a, b, c . . . as shown, respective active phases 72*a*, 72*b*, 72*c* . . . ; inactive phases 74*a*, 74*b*, 74*c* . . . ; and driving phases 76*a*, 76*b*, 76*c* . . . can be provided to periodically refresh the display. This method is particularly useful for displays of timing devices, such as watches, for example, that need be regularly updated for only short intervals.

Of course, non-uniform or non-regular updates could also be supported, such as by controlling the timings and durations of the phases on a more irregular but periodic basis, or even on an as-needed basis, possibly leading to more randomly spaced and/or positioned phases than those shown in FIG. 4, which may not even be periodic, or might have variable frequencies of updates. Such non-regular and/or non-uniform schemes could be controlled by the controller 12 based on a driving program, for example, or some other triggering event or entity, for example.

Accordingly, a myriad of various timings and durations for the various phases are possible, and thus can be chosen for the particular application that is being utilized. The example schemes shown in FIG. 4 are merely exemplary, and thus not limiting.

For more practical examples, existing voltage conversion circuitry, such as used in OTS devices, can be used in the manner described above to maximize the number of updates achievable with the display, such as a liquid crystal display (e.g. a ChLCD or other display) utilizing a single battery. When using a ChLCD or some other types of bistable displays, there is the advantage that no power is required to maintain a static image, and thus stored energy is only necessary during a display update, which may be only a fraction of the time a relatively static image is displayed. Accordingly, the display might need power for only a small fraction of the time that an image is displayed, and then only when the image is changed or updated.

A specific example of an OTS converter that could be utilized is the Texas Instruments TPS61041, described as a "Low Power DC/DC Boost Converter in SOT-23 Package". Many such similar devices exist from various manufacturers, as well as similar devices based on capacitive charge pumps or inductive switching circuitry. Additionally, charge pumps are often included directly in the LCD driver IC's (for example, see the Samsung S6B0724) and E-Paper driver IC's (for example, Solomon Systech SSD1622) used to drive the displays.

One example implementation using a discrete converter focuses on using the Texas Instruments TPS61041 converter chip; however, it is appreciated that one could implement such concepts using other similar commercially provided conversion circuitry. This includes dc-to-dc conversion circuitry integrated into a display driver/controller IC, as in an example discussed in more detail below.

One primary difficulty with achieving long battery lifetimes with small display devices, such as ChLCD devices, is that the quiescent current of the voltage conversion circuitry can be relatively large. For example, the device datasheet for the TPS61041 lists a typical no-load quiescent current as 28 μA, whereas the typical shutdown current is only 0.1 μA. In an electronic watch application, for example, even if the device leaves shutdown only during the time when the display update is occurring (i.e., the display is being driven), this no-load quiescent current is too large to typically provide the desired battery lifetime.

Fortunately, monochrome operation of ChLCDs, for example, does not require precise drive voltages. This is particularly true of the direct drive segmented type displays that may be used in small, low power devices. These small devices also typically have a very low current requirement on the drive voltages. Thus, it is feasible to provide a drive voltage to the display from a storage device including, for example, a charge stored in storage capacitors, with the conversion circuitry disabled when not charging the capacitors.

In a first example implementation for driving a ChLCD device for this example embodiment, the planar drive voltages are applied to the display for 30 ms, with the focal conic drive voltages subsequently applied for the following 30 ms. Thus, the display drives for 60 ms per update, which occurs once per second for a watch operating in a time-of-day mode (with the "seconds digits" updating once every second). In this example embodiment, the dc-to-dc conversion circuitry is enabled (active phase) for significantly less time than the drive voltages are applied to the display (driving phase). In this example implementation, the active phase duration can, for the example case of a watch device, be made around 1 ms or less for each update. This duration is typically sufficient to charge up the storage device (e.g. drive voltage storage capacitors), which is sufficiently sized such that the voltage levels do not drop beyond permissible levels over the course of the update (driving phase).

Thus, for a low-powered device, such as a watch, for example, the 28 uA quiescent current draw is typically applicable for less than 1 ms out of every second. In comparison, common bistable display applications typically enable the dc-to-dc conversion circuitry for much longer durations. For a bistable display, power may only be required during display updates. Thus, it is common for the dc-to-dc conversion circuitry to be enabled for an initialization period prior to a bistable display update, and then remain enabled during the display drive period (the driving phase). In this example implementation, this would lead to the dc-to-dc conversion circuitry being enabled (active phase) for at least 60 ms out of every second. Reducing the 28 uA quiescent current draw from greater than 60 ms per second down to less than 1 ms per second can result in a significant increase in battery life, for example.

Note that the very low shutdown current of 0.1 μA is applicable during the remainder of the one second period in which the dc-to-dc converter is disabled (the inactive phase). If desired, even this current may be saved by gating off power to the external dc-to-dc converter IC rather than just disabling the IC, reducing the power draw to about zero. This is shown by example in FIG. 1 as the optional switch 19, which could be controlled, for example, by the controller 14.

Figure 2A:
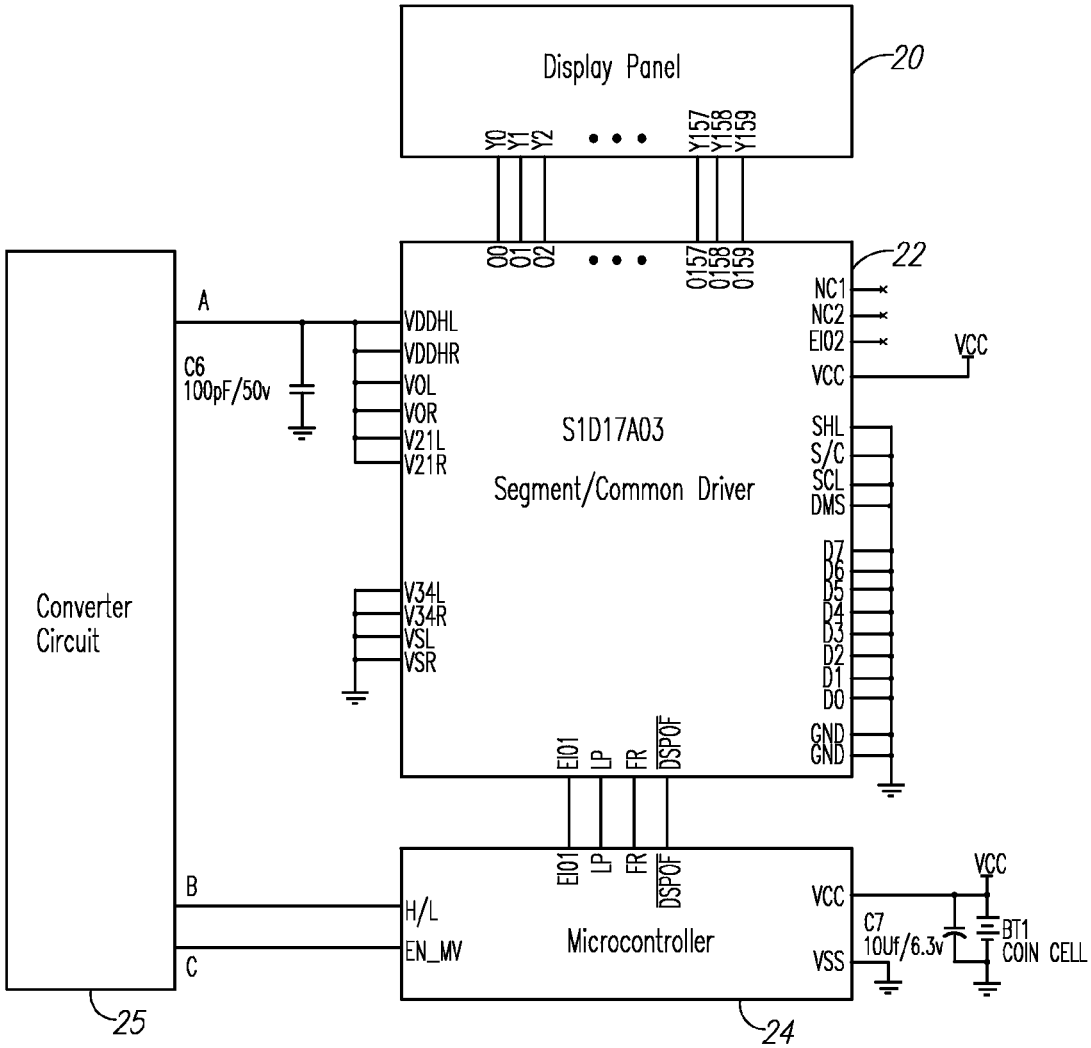
FIG. 2 shows an embodiment utilizing a Low Power Display with commercially available DC/DC Boost Converter and Display Driver in Separate Integrated Circuits.
Figure 2B:
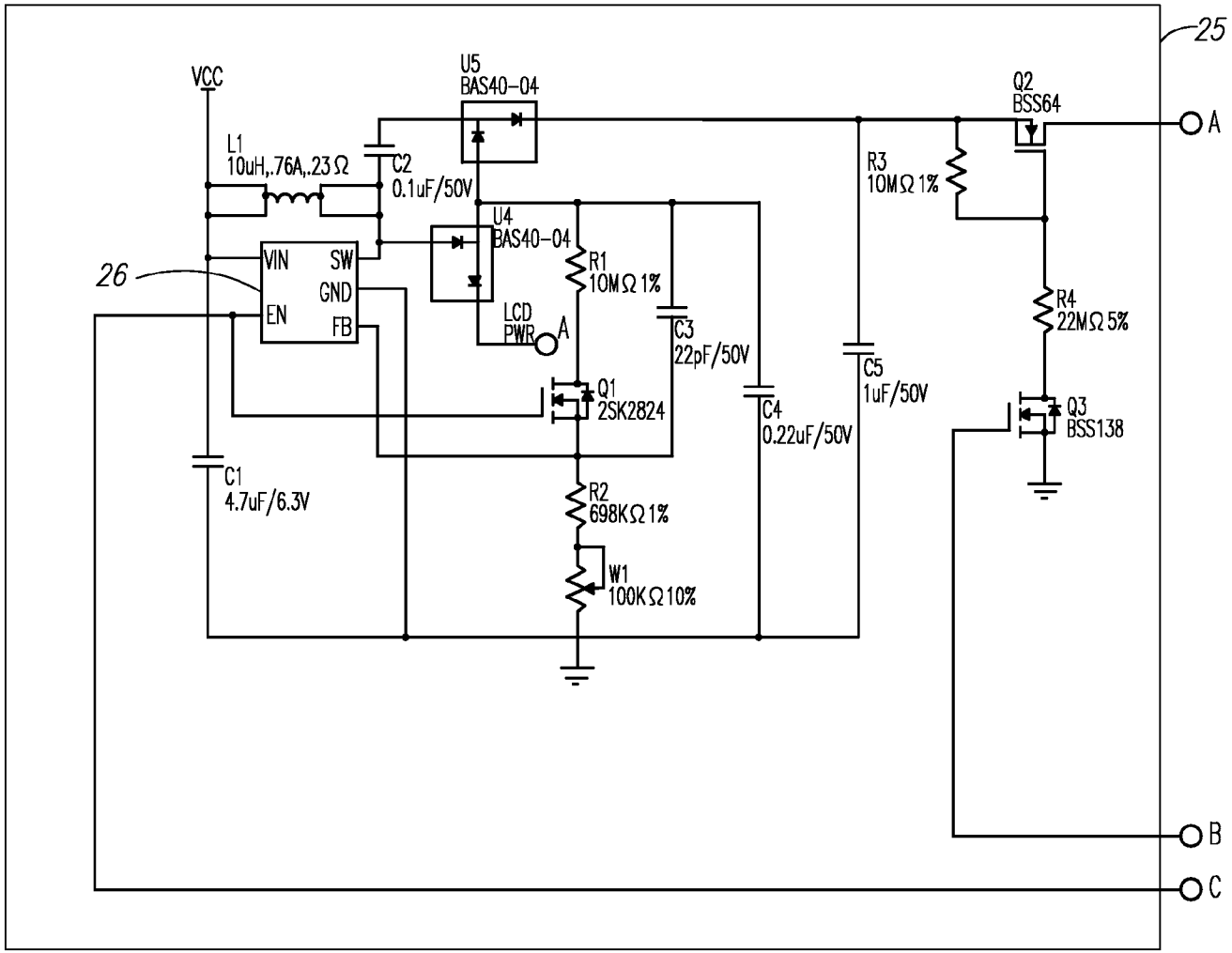

The example implementation shown in FIG. 2A is comprised of a display panel 20, such as a bistable ChLCD display panel, a driver chip 22 such as an Epson S1D17A03 driver, a microcontroller 24, and a converter circuit 25. The converter circuit 25 is shown in more detail in FIG. 2B, with converter 26 having dc-to-dc conversion circuitry, where in this case the TI TPS61041 boost converter IC is utilized for the converter 26. The S1D17A03 is externally configured as a "common" driver. Typically, this configuration may be used to drive a segmented display, where 1 or more of the outputs are used as backplanes and the remainder are used to control individual segments. The display panel is accordingly a segmented display.

The microcontroller 24 communicates update data to the driver 22 through the EIO1 and LP signals, while waveform timing is controlled by the FR and DSPOF signals. These signals, as well as the EN_HV and H/L signals used to control the dc-to-dc conversion circuitry 26, are logic signals that may be implemented as general purpose I/O on any common microcontroller. An example of an acceptable controller would be the MSP 430 series from Texas Instruments.

When high, the EN_HV signal enables the TPS61041 boost converter as well as turns on transistor Q1, which enables the feedback signal used by the TPS61041 to regulate voltage. When low, the EN_HV signal puts the TPS61041 into shutdown and turns off transistor Q1 such that the voltage feedback circuit does not unnecessarily drain charge from storage capacitor C4. When enabled, the converter circuit generates 17.5V (tunable using W1) on capacitor C4, and a voltage doubler generates twice this voltage, nominally 35V, on C5.

The H/L signal is set high to turn on transistors Q3 and Q2, which provides 35V from capacitor C5 to the driver chip 22. This is used during the first 30 ms of drive in which segments of the display 20 are written to the planar (bright) ChLCD state. The H/L signal is set low during the second 30 ms drive period in which segments are written to the focal conic (dark) ChLCD state. When H/L is low, transistors Q2 and Q3 are off, and 17.5 volts is supplied to the driver chip (LCD_PWR signal) from capacitor C4 through a diode.

Figure 3:
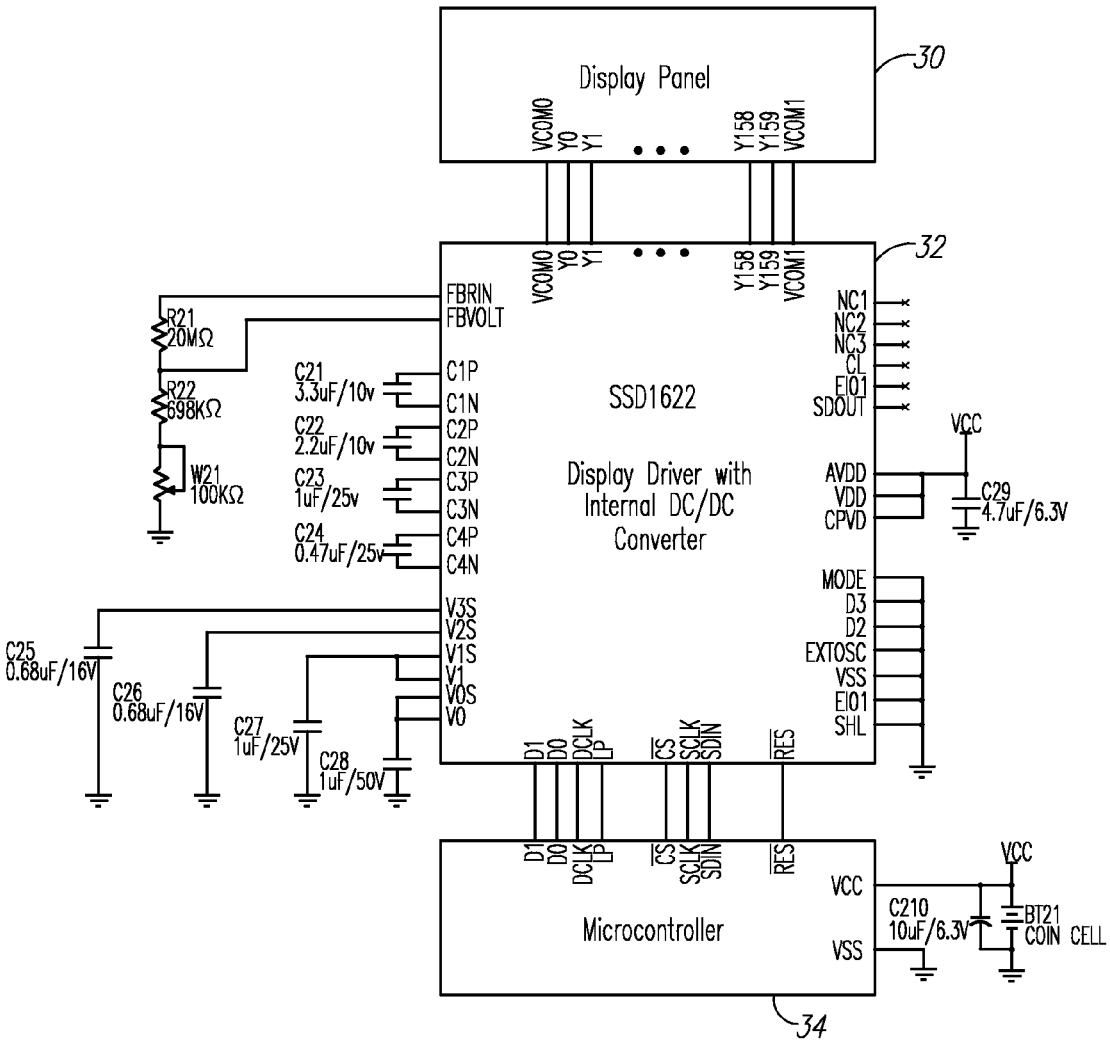
FIG. 3 shows an embodiment utilizing a Low Power Display with a commercially available DC/DC Converter Internal to a Driver Integrated Circuit.

An alternative implementation, shown in FIG. 3, is comprised of a display panel 30, such as a bistable ChLCD display panel, a driver 32 with integrated converter, such as a Solomon SSD1622 display driver (described as 160-Channel 3-Level Generic Bistable Display Driver) with internal dc/dc converter, and a microcontroller 34. The SSD1622 driver may drive a display panel with up to two backplanes and 160 individual segments. The display panel 30 is accordingly a segmented display.

The microcontroller 34 resets the driver 32 using the RES signal and configures the driver's internal operation using the CS, SCLK, and SDIN signals. Display data is communicated to the driver 32 using the D1, D0, DCLK, and LP signals. These signals may be generated using the general purpose I/O available on any common microcontroller. Alternatively, SCLK and SDIN may be generated by a microcontroller SPI port.

The SSD1622 implements a charge pump using capacitors C21 through C28. The charge pump generates 17.5V on V1 (tunable using W1) and twice this voltage (nominally 35V) on V0. Capacitors C27 and C28 effectively act as the storage device.

The SSD1622 is a 3-level driver, capable of driving ground, a high level voltage (V0), and a midlevel voltage (V1) simultaneously to different pins. It is thus possible to simultaneously drive some segments to the planar state and others to the focal conic state. Thus, rather than 60 ms of drive time (30 ms of planar plus 30 ms of focal conic) every second in a watch application, the SSD1622 uses a total of 30 ms of drive time (30 ms combined planar and focal conic) every second.

The dc-to-dc converter in the SSD1622 may be enabled or disabled at any time through the configuration interface. Typically, in a watch application, a total of 4 ms of enable time is used prior to each update in order to top off the charge storage capacitors.

Variations of the above described approach are readily apparent, with the dc-to-dc conversion circuitry (and/or other driver circuitry) selectively enabled and disabled at other portions of the waveform. In the above examples, the converter is enabled for a brief period before each update. However, it is similarly possible to enable the dc/dc converter for a brief period to charge up the capacitors prior to a select set of transitions or even every transition in the drive waveforms. Alternatively, the converter could be disabled only in between waveform transitions, when the drivers are outputting constant voltages, and enabled otherwise. The method is not limited to a specific driver IC or drive waveform. One key point is that during portions of the drive waveform, the drive voltages are being supplied by storage capacitors during which the voltage conversion circuitry can be disabled (thus greatly reducing any quiescent power loss).

Other driver circuitry may be selectively enabled and disabled as well. For example, the bandgap reference in the SSD1622 is only required when the dc-to-dc converter is enabled, but it has separate control. The configuration interface may be used to turn this reference off at the same times as the dc-to-dc converter. Additionally, the SSD1622 has an internal oscillator which typically runs whenever the display is not in its low power off mode. However, the oscillator is only required when the dc-to-dc converter is running or when transitions on the driver outputs are being generated. This internal oscillator may thus be disabled during constant periods in the drive waveforms, in addition to the longer periods between display updates. Because the oscillator must run during waveform transitions, another approach is to enable the dc/dc converter during this same time in order to minimize the time which the oscillator must run.

For a ChLCD, the storage capacitors should be of sufficient capacity such that the voltage on them drops by no more than a few hundred milivolts during an update. Factors affecting the amount of voltage drop include the capacitance of the LC, the number of transitions in the drive waveforms, and leakage currents. As an alternative strategy, enabling the dc-to-dc converter at multiple points during an update could allow the use of smaller capacitors than would be possible by only enabling the dc/dc converter once per update, as discussed above. Thus, a plurality of active phases could be provided during each driving phase, if a smaller energy storage capacity is desirable.

One advantage of the described methods is that it can extend battery lifetimes for extremely low powered displays, such as ChLCDs. The method is enabled by the imprecise voltage requirement and low drive currents typically utilized for certain low-power and/or bistable displays. Furthermore, the invention can be utilized in a device and method for driving a display as disclosed in application Ser. No. 60/822,128 and incorporated herein by reference.

The invention has been described hereinabove using specific examples and embodiments; however, it will be understood by those skilled in the art that various alternatives may be used and equivalents may be substituted for elements and/or steps described herein, without deviating from the scope of the invention. Modifications may be necessary to adapt the invention to a particular situation or to particular needs without departing from the scope of the invention. It is intended that the invention not be limited to the particular implementations and embodiments described herein, but that the claims be given their broadest interpretation to cover all embodiments, literal or equivalent, disclosed or not, covered thereby.

What is claimed is:

1. An apparatus for driving a display, comprising:

a power supply for outputting energy at a supply voltage;

a converter for converting the supply voltage of the power supply into a converted voltage;

a controller for controlling an operation of said converter; and an energy storage device for storing energy outputted by said converter at said converted voltage, said storage device also for providing stored energy to said display; wherein said controller controls said converter such that said converter supplies said converted voltage to said storage device for a first time interval but not for a second time interval, wherein said first time interval has a duration that is less than the duration of said second time interval; and wherein said storage device supplies a driving voltage to said display during said second time interval, said driving voltage sufficient to drive said display.

2. The apparatus of claim 1, wherein the display includes a display driver connected to said energy storage device, and a bistable LCD connected to said display driver.

3. The apparatus of claim 2, wherein said LCD is a ChLCD.

4. The apparatus of claim 2, wherein said controller also controls said display driver.

5. The apparatus of claim 1, wherein said second time interval begins at the end of said first time interval.

6. The apparatus of claim 1, wherein said converter is a dc-to-dc converter and wherein said energy storage device includes a capacitor.

7. The apparatus of claim 1, wherein the duration said second time interval is about 7.5 times or more the duration of said first time interval.

8. The apparatus of claim 1, wherein the duration of said first time interval is about 4 ms or less, and wherein the duration of said second time interval is about 30 ms or more.

9. The apparatus of claim 1, wherein during a third time interval, neither is said converter providing said converted voltage nor is said storage device providing stored energy to said display.

10. The apparatus of claim 1, further comprising a switch for disconnecting said converter from said power supply when said converter is not supplying said converted voltage to said storage device.

11. The apparatus of claim 1, further comprising an oscillator, wherein said oscillator is enabled and disabled periodically in coordination with driving said display.

12. An apparatus for driving a display, comprising:

a power supply for outputting energy at a supply voltage;

a converter for converting the supply voltage of the power supply into a converted voltage; and an energy storage device for storing energy outputted by said converter at said converted voltage, said storage device also for providing stored energy to said display; wherein said apparatus is adapted such that said converter circuit provides energy at said converted voltage to said storage device to charge said storage device during a converter active phase, and wherein said apparatus is adapted to deactivate said converter during a converter inactive phase where said converter is not providing any substantial energy to said energy storage device, such that a consumption of power by said converter is substantially reduced during said inactive phase, and further wherein said storage device provides stored energy to said display for updating a display image during a driving phase that overlaps at least a substantial portion of said inactive phase.

13. The apparatus of claim 12, wherein the duration of said driving phase is of a duration at least as long as said active phase.

14. The apparatus of claim 13, wherein said driving phase also overlaps at least a portion of said active phase.

15. The apparatus of claim 12, wherein said driving phase is about 7.5 or more times the duration of said active phase.

16. The apparatus of claim 12, wherein the duration of said driving phase is about 7.5 or more times the duration of said active phase and wherein the duration of said inactive phase is about ten times or more the duration of said driving phase.

17. The apparatus of claim 12, wherein the duration of said active phase is about 4 ms or less, wherein the duration of said driving phase is about 30 ms or more, but less than the duration of said inactive phase.

18. The apparatus of claim 12, wherein the display includes a display driver connected to said energy storage device, and a bistable LCD connected to said display driver.

19. The apparatus of claim 18, wherein said LCD is ChLCD.

20. The apparatus of claim 12, further comprising a controller for controlling the timing and durations of said active, inactive, and driving phases.

21. The apparatus of claim 12, wherein, during said active phase, said converter provides energy for storage in said storage device and said converter supplies energy to drive said display.

22. The apparatus of claim 12, further comprising a switch for disconnecting said converter from said power supply during said inactive phase.

23. The apparatus of claim 12, further comprising an oscillator, wherein said oscillator is enabled and disabled periodically in coordination with driving said display.

24. An apparatus for driving an LCD display, comprising:

a dc power supply for outputting energy at a supply voltage;

a dc-to-dc converter for converting the supply voltage of the power supply into a converted voltage;

a driver for driving said display;

an energy storage device for storing energy outputted by said converter at said converted voltage, said storage device also for providing stored energy to said display driver; and a controller for controlling a timing of an active phase, an inactive phase, and a driving phase, wherein said controller controls said converter for providing energy at said converted voltage to said storage device to charge said storage device during the active phase, and wherein said controller deactivates said converter during the inactive phase such that said converter is not providing any substantial energy to said energy storage device, wherein a consumption of power by said converter is substantially reduced during said inactive phase, and further wherein said storage device provides stored energy to said display driver for updating a display image on said display during at least a substantial portion of said driving phase that does not overlap with said active phase, and wherein the duration of said driving phase is longer than the duration of said active phase.

25. A watch utilizing said apparatus and said LCD display of claim 24, wherein the duration of said active phase is about 4 ms or less, wherein the duration of said driving phase is between 30 ms and 60 ms, and wherein the duration of said inactive phase is greater than the duration of said driving phase.

26. The apparatus of claim 24, wherein the duration of said inactive phase is longer than the duration of said driving phase is longer than the duration of said active phase.

27. The apparatus of claim 24, further comprising a switch for disconnecting said converter from said power supply during said inactive phase.

28. The apparatus of claim 24, wherein said driver includes an oscillator, and wherein said oscillator is enabled during said driving phase and disabled during at least some portion where said inactive phase does not overlap said driving phase.

29. The apparatus of claim 24, wherein said converter is integrated with said driver on a single chip.

30. A method of using a commercial voltage converter to power a display, said method comprising the steps of:

storing energy provided by the converter during an active phase;

not providing energy from the converter during an inactive phase, wherein power consumption by said converter during said inactive phase is substantially reduced; and updating an image on a display during at least a portion of said inactive phase using stored energy, wherein the duration of said at least a portion of said inactive phase is longer than the duration of said active phase.

31. The method of claim 30, wherein said active phase and said inactive phase are controlled by a controller external to, and connected to the converter, and wherein said energy is stored in an energy storage device including a capacitor, and further wherein the display includes an LCD and a driver.

32. The method of claim 30, wherein the duration of said at least a portion of said inactive phase is more than twice the duration of said active phase.

* * * * *